US007326166B2

(12) United States Patent
Sytema

(10) Patent No.: US 7,326,166 B2
(45) Date of Patent: Feb. 5, 2008

(54) METHOD AND APPARATUS FOR FOLDING SHEETS OF PAPER

(75) Inventor: Herman Sytema, Terhorne (NL)

(73) Assignee: Neopost S.A., Bagneux (FR)

( * ) Notice: Subject to any disclaimer, the term of this patent is extended or adjusted under 35 U.S.C. 154(b) by 41 days.

(21) Appl. No.: 11/320,551

(22) Filed: Dec. 28, 2005

(65) Prior Publication Data

US 2006/0148630 A1 Jul. 6, 2006

(30) Foreign Application Priority Data

Dec. 31, 2004 (NL) ..... 1027939

(51) Int. Cl.
*B31F 1/10* (2006.01)

(52) U.S. Cl. ..... 493/421; 493/419; 493/420; 493/442; 493/444

(58) Field of Classification Search ..... 493/419, 493/420, 421, 442, 444
See application file for complete search history.

(56) References Cited

U.S. PATENT DOCUMENTS 4,985,013 A * 1/1991 van der Werff et al. .... 493/444
5,090,671 A * 2/1992 Gombault et al. ..... 270/45
5,490,829 A 2/1996 Beord et al. ..... 493/419
6,024,682 A * 2/2000 Mandel et al. ..... 493/23
6,592,506 B1 * 7/2003 Lyga ..... 493/424

FOREIGN PATENT DOCUMENTS

| | | |
|---|---|---|
| DE | 198 37 238 A1 | 2/2000 |
| EP | 0 312 177 A1 | 4/1989 |
| JP | 63001675 | 1/1988 |

* cited by examiner

*Primary Examiner*—Christopher Harmon

(57) ABSTRACT

For folding a sheet of paper, a portion of the sheet situated between opposite ends of the sheet is bent to a folding nip between a pair of folding rollers. By rotating the folding rollers in an output rotation sense, whereby sections of the folding rollers in the area of the folding nip transport the bent portion of the sheet into the folding nip, and transporting the bent portion of the sheet through the folding nip, a fold is formed in the bent portion of the sheet. Prior to the rotation of the folding rollers in the output rotation sense, at least a portion of the sheet is supplied between the folding rollers by rotating the folding rollers in an input rotation sense opposite to the output rotation sense. An apparatus for folding is also described.

12 Claims, 5 Drawing Sheets

METHOD AND APPARATUS FOR FOLDING SHEETS OF PAPER

CROSS-REFERENCE TO RELATED APPLICATIONS

This application claims priority from Dutch Patent Application No. NL 1027939, filed on Dec. 31, 2004.

FIELD AND BACKGROUND OF THE INVENTION

The invention relates to a method for folding sheets of paper and to an apparatus for folding sheets of paper.

In U.S. Pat. No. 5,490,829, a method and apparatus for folding a sheet are described in which a sheet to be folded is supplied via a nip between a pair of transport rollers and through a gap between a pair of pivotally suspended guides. When a leading portion of the sheets has arrived between a pair of folding rollers downstream of the guides, the folding rollers are stopped and the guides are pivoted while the transport rollers supply the paper over some further distance. This causes the sheet to buckle and results in a loop in the sheet.

Next, the guides are swung back, whereby transport rollers arranged on the guides clamp the sheet against the one of the folding rollers that is situated on the side of the folding gap where also the loop has been formed and where the guides had been swung to. By proceeding to drive both the folding rollers and the transport rollers, a bend in the sheet is urged between the folding rollers, whereby a first fold is formed. Thereupon, the loop together with the rest of the sheet also passes through the folding gap, in which the trailing end of the loop is pressed flat, so that a second fold is formed. Thus, with a single folding gap, two folds are formed.

SUMMARY OF THE INVENTION

It is an object of the invention to provide a more simply feasible solution for folding a sheet using a pair of folding rollers.

This object is achieved according to the invention by providing a method for folding a sheet of paper, comprising:

supplying a sheet between a pair of folding rollers rotating in an input rotation sense;

causing the first section of the sheet to buckle into the loop by, during rotation of the folding rollers in the input rotation sense, stopping with respect to portions of the sheet transported between the folding rollers a portion of the sheet remotely downstream of the folding rollers;

bending a second section of the sheet situated between opposite ends of the sheet on a side of the loop remote from the folding rollers to a folding nip between a pair of folding rollers;

rotating the folding rollers in an output rotation sense opposite to the input rotation sense, whereby sections of the folding rollers in the area of the folding nip transport said bent second section of the sheet into the folding nip; and transporting the bent portion of the sheet through the folding nip, whereby a first fold is formed in said second section of the sheet and subsequently a trailing end of the loop is deformed into a second fold.

The invention may also be embodied in an apparatus for folding a sheet of paper, comprising:

a pair of folding rollers which define a folding nip situated therebetween;

a drive coupled with the folding rollers, with a control for rotating the folding rollers in an input rotation sense for supplying at least a portion of the sheet through the folding nip;

a buckle chute downstream of the folding rollers, for, during rotation of the folding rollers in the input rotation sense for supplying the sheet, stopping a portion of the sheet with respect to portions of the sheet transported between the folding rollers, causing a first section of the sheet to buckle into a loop;

means for bending a second section of the sheet situated between opposite ends of the sheet on a side of the loop remote from the folding rollers to the folding nip; and the drive coupled with the folding rollers, with the control being arranged for subsequently rotating the folding rollers in an output rotation sense opposite to the input rotation sense, whereby the bent portion of the sheet is transported through the folding nip and a first fold is formed in said second section and subsequently a trailing end of the loop is deformed into a second fold.

As in the method and apparatus according to the invention supplying the sheet is done by suitably driving the folding rollers, supplying the sheet does not require any separate set of transport rollers with associated drive. An additional advantage is that the sheets after folding are outputted on the side of the folding nip from where they have been supplied. This makes it simpler to realize a machine lay-out whereby input and output are situated on the same side of the machine, so that the user can perform both operations on the same side of the machine.

Although in the foregoing reference has been made to folding a sheet, it will be clear to one skilled in the art that this should be understood to include the simultaneous folding of two or more sheets stacked onto each other. In principle, it makes no difference for the invention whether, in addition to the one sheet mentioned, any other sheets stacked onto it are simultaneously folded along with it.

Features of particular embodiments of the invention are laid down in the dependent claims.

Further features, effects and details of the invention are described in the detailed description.

DETAILED DESCRIPTION

Figure 1:
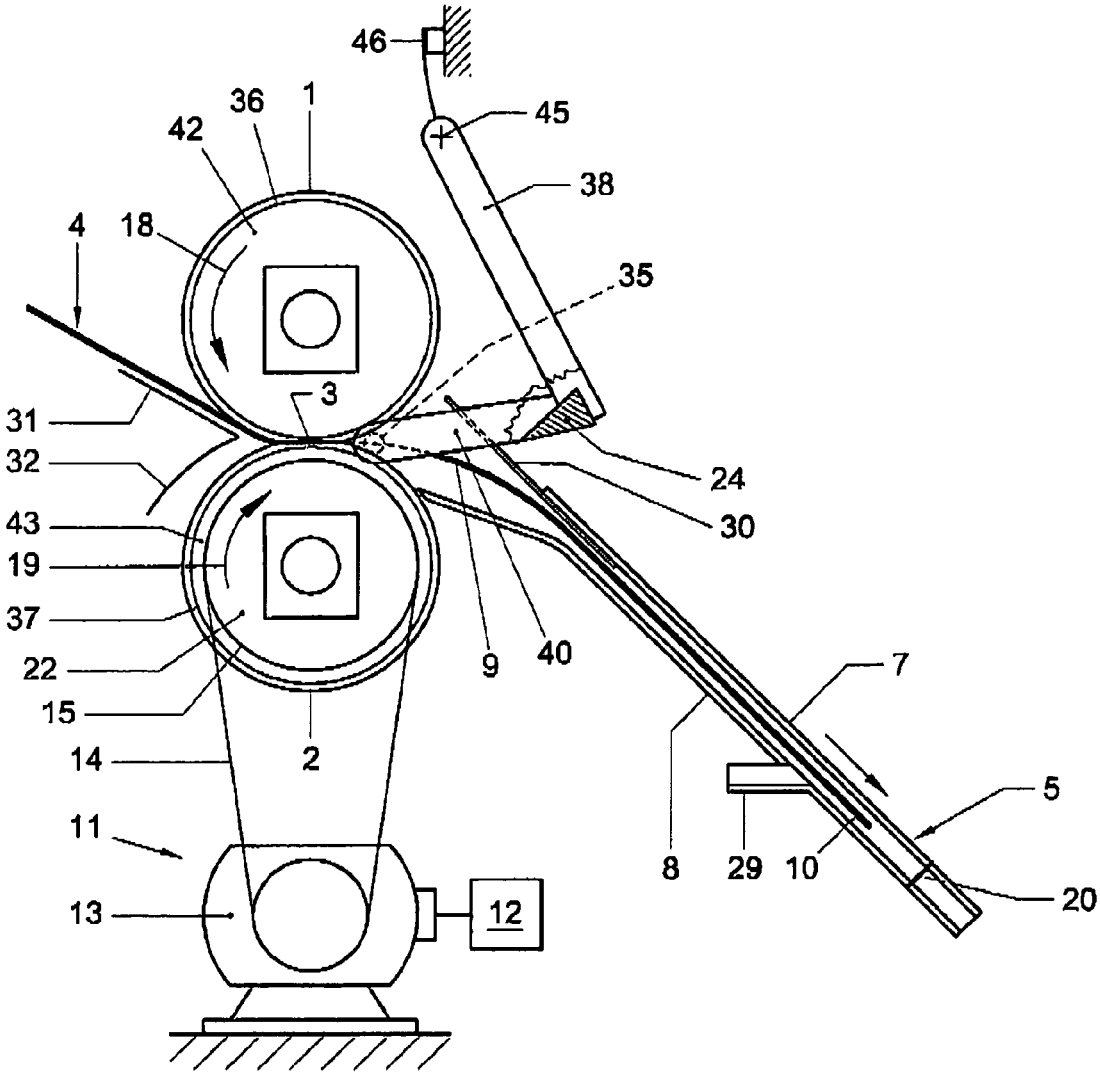
FIGS. 1-4 are schematic, partially cutaway representations in side elevation of an example of a folding apparatus according to the invention in successive operating stages.

The apparatus for folding a sheet of paper according to the example represented in the drawing is equipped with a pair of folding rollers 1, 2 which define a folding nip 3 situated between them.

For guiding a sheet 4 extending through the folding nip 3, a transport path is provided, which, according to this example, is formed by guides 7, 8 jointly forming a buckle chute 5. The folding rollers 1, 2 extend throughout the width of the sheet 4, so that they can form a fold which extends throughout the width of the sheet 4. In this respect, folding rollers typically differ from transport rollers which are typically narrower than the greatest dimension transverse to the direction of transport of the sheets to be transported.

A first section 9 of the sheet, measured along the sheet 4, is situated closer to the folding nip 3 than a second section 10. For causing the first, section 9 of the sheet 4 to buckle into a loop 6, the apparatus is equipped with a drive 11 and a control 12. The drive according to this example is made up of a motor 13, a drive belt 14, a pulley 15 which is connected with the folding roller 2 for driving rotation thereof and a clutch 16 which connects the folding rollers with the motor, such that upon reversal of the rotation direction to the output direction the folding rollers are not driven until after the input shaft 33 of the clutch has rotated through an angle. This angle can be, for instance, between 20° and 300°. According to this example, the clutch 16 is designed as a lost motion clutch, whose output shaft 34 upon each reversal of the rotation direction of the input shaft 33 is not carried along until after the input shaft 33 has rotated through a certain angle.

Figure 2:
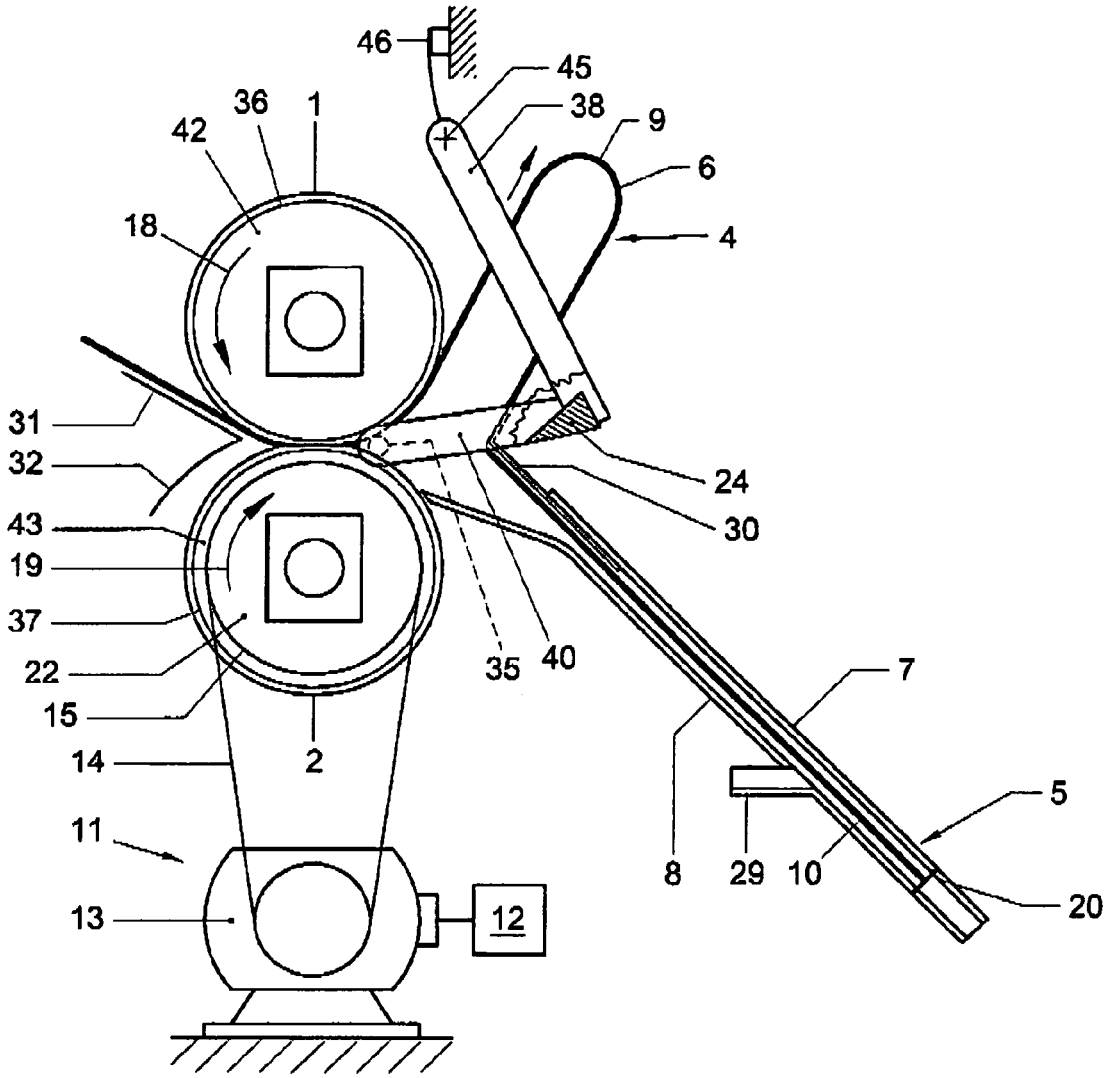

The drive 11 and the control 12 are arranged for driving the folding rollers 1, 2 in an input rotation sense (arrows 18, 19 in FIGS. 1 and 2). Further, for causing the sheet 4 to buckle, the apparatus according to this example is equipped with a detainer in the form of a stop 20 in the buckle chute 5 for stopping, with respect to the portions of the sheet 4 transported between the folding rollers 1, 2, a portion of the sheet 4 in the transport path 7, 8 downstream of the folding rollers 1, 2.

According to this example, the stop is of fixed design, but, depending on the setting possibilities contemplated, may be manually or mechanically settable. The stop may for instance be coupled to the drive of the folding rollers, so that the stop travels along with the sheet 4 up to the correct position. That position could be determined electronically, for instance by means of a pulse disc and a switching clutch. In this way, the folding process can be controlled wholly electronically and each fold can be different from the preceding one, thus yielding an extremely flexible folding system. The stop-clutch switches on at the moment when the paper enters and switches off after a particular number of pulses. At the moment when the folding rollers are going to reverse, the clutch switches on again and the stop travels back to its initial position. Having arrived there, the clutch switches off again, waiting for the next cycle.

It is also possible, for instance, to use a pair of rollers or a clamping member to stop the leading portion of the sheet 4 when the sheet 4 is to be caused to buckle.

Figure 3:
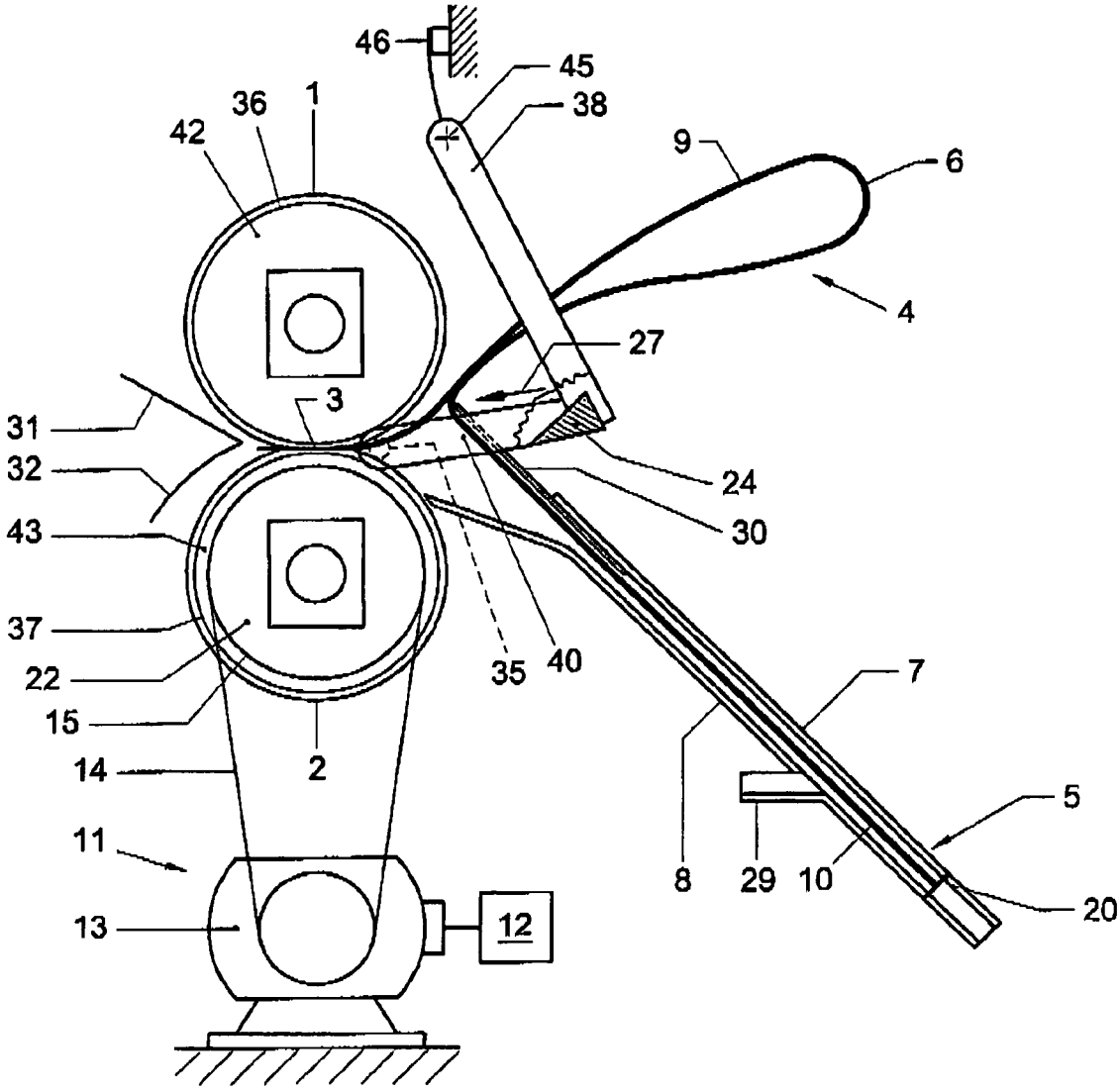
Figure 4:
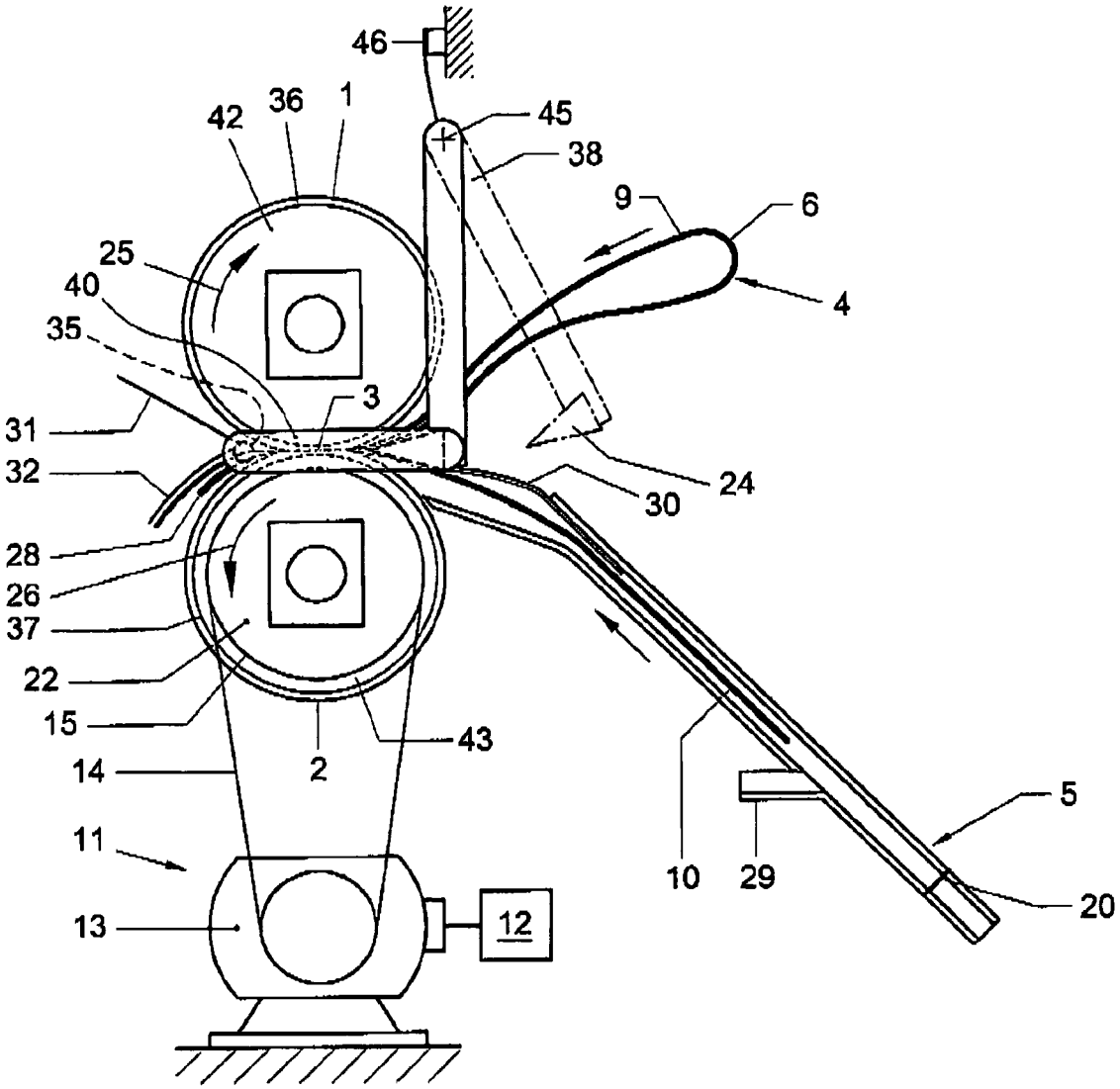

Means for bending the second section 10 of the sheet 4 to the folding nip are formed, according to this example, by a folding blade 24 which is reciprocable between the positions represented in FIGS. 1-3 and in FIG. 4.

The drive 11 and the control 12 are further arranged for rotating the folding rollers 1, 2 with an output rotation sense (arrows 25, 26 in FIG. 4), such that the second section 10 of the sheet 4 is transported into the folding nip 3.

In operation, the folding of a sheet in the apparatus shown starts with introducing the sheet 4 into the folding nip 3 between the folding rollers 1, 2. In the condition represented in FIG. 1, the sheet 4 has already been transported over such a distance as to have nearly reached the stop 20.

FIG. 2 shows the buckling into a loop 6 of the first section 9 of the sheet 4, which first section, measured along the sheet 4, is situated closer to the folding nip 3 than is the second section 10. To this end, the folding rollers 1, 2 are rotated further in the input rotation sense indicated by arrows 18, 19, whereby portions of the sheet 4 situated between the folding rollers 1, 2 are transported with a directional component in a direction towards the second section 10. With respect to the portions of the sheet 4 transported between the folding rollers 1, 2, a portion of the sheet 4 downstream of the folding rollers 1, 2 is stopped in that it butts against the stop 20 in the buckle chute 5. Such arrest can also be implemented in a different manner, for instance by clamping a portion of the sheet 4 downstream of the folding rollers 1, 2, for instance by means of a gripper or between transport rollers.

Rotating the folding rollers 1, 2 is continued, until the operative condition represented in FIG. 3 has been reached, in which a trailing end portion of the sheet 4 is just being held between the folding rollers 1, 2. This operative condition can for instance be detected with a suitably placed sensor or on the basis of angular displacement of the rollers. Next, the second section 10 of the sheet 4 is urged towards the folding nip 3. This is realized according to this example in that the folding blade 24, on a side of the sheet 4 remote from the folding nip 3, is moved towards the folding nip 3, as indicated in FIG. 3 with an arrow 27. Thus, introducing the second section 10 of the sheet into the folding nip is accurately controlled with simple means.

The folding rollers 1, 2 are rotated in an output rotation sense (arrows 25, 26 in FIG. 4), whereby the sections of the folding rollers 1, 2 in the area of the folding nip 3 transport the second section 10 into the folding nip 3 and a first fold 28 (see FIG. 4) is formed. The folding rollers 1, 2 proceed to rotate further, so that also the first section 9 of the sheet 4 is transported through the folding nip 3 and a second fold, spaced from said first fold, is formed, in that the loop 6 is folded flat. Rotating the folding rollers 1, 2 in the output rotation sense is preferably started simultaneously with or after the second section 10 has been urged to the folding nip 3, so that the first fold 28 comes to lie close to the edge of the sheet 4 which has not passed the folding nip 3.

When the sheet 4 has been outputted, the folding blade 24 is moved back to its initial position. This can for instance be done during the introduction of a next sheet 4 to be folded.

Within the framework of the invention, it is also possible to provide only a single fold in the sheet 4. To that end, the transport of the sheet 4 by the folding rollers 1, 2 is not stopped in the position represented in FIG. 3, but is continued until the trailing edge of the sheet 4 has passed through the nip 3 between the folding rollers 1, 2. The trailing edge of the sheet thereupon springs back, owing to the bending stiffness of the sheet 4 and possibly supported by rotation of the folding roller 1, to a position extending along the folding rollers on the side of the folding blade 24. The provision of the fold is thereupon effected correspondingly to the provision of the first fold 28 in the above-described example.

For the accurate control of the position where the second fold is provided, it is advantageous to prevent the sheet being moved out of the buckle chute 5 prematurely due to the second section 10 thereof being urged to the folding nip 3. To that end, the buckle chute 5 is equipped with a flexible sheet catcher 29 which, when the sheet 4 passes into the buckle chute, bends away owing to the pressure of the sheet 4, and hence gives the sheet 4 room to move past the catcher 29. When the second section of the sheet 4 is urged towards the folding nip 3, the catcher 29 retains the sheet 4 by wedge action, so firmly as to prevent its moving away from the stop 20 in the buckle chute 5. When the folding rollers engage the second section 10, however, and pull it into the folding nip 3, the holding force exerted on the sheet 24 by the catcher 29 is overcome and the sheet 4 passes out of the buckle chute 5.

The buckle chute 5 has at its inlet a flexible guide 30, by which the sheet 4, when being introduced via the folding nip 3, is guided into the buckle chute 5. Because the path along which the folding blade 24 is reciprocable intersects the guide 30, the guide 30 is made so flexible as to be elastically bent when the folding blade 24 is moved to the folding nip 3 for urging the second section 10 of the sheet 4 to the folding nip 3. When the folding blade 24 moves back again, the elastic guide 30 springs back again. The flexible guide 30 moreover yields during the formation of the loop 6 (see FIG. 2), so that the loop 6 is easily formed and unintended formation of buckles in the sheet 4 is prevented.

The size of the loop 6 determines the position of the second fold and is determined by the moment when the folding rollers 1, 2 stop feeding through.

According to this example, the drive of the blade 24 includes inter alia the motor 13, as well as a transmission which is coupled with the folding blade 24 for selectively driving displacements of the folding blade 24 towards the folding nip 3 and away from the folding nip 3 and with the folding rollers 1, 2 for each time at or after one of the displacements of the blade 24 reversing the rotation sense in which the folding rollers 1, 2 are driven. Thus, no separate motor with associated supply and control is needed for driving the movements of the folding blade 24.

Figure 5:
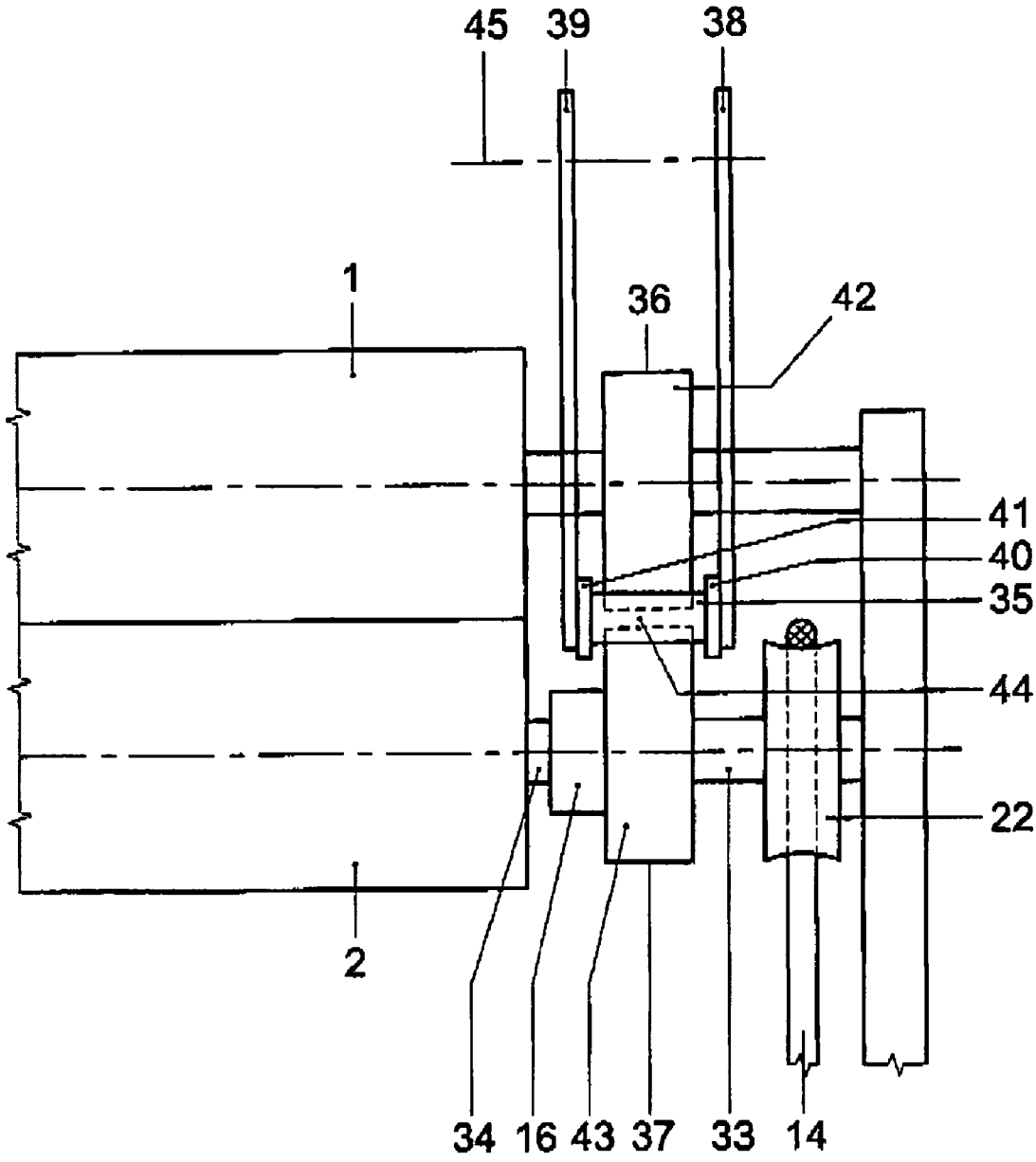
FIG. 5 is a schematic front view of a portion of the apparatus according to FIGS. 1-4.

According to this example, the transmission is equipped with a carrier pawl 35 which is coupled with the folding blade 24 via carrier arms 40, 41, and a pair of circulating surfaces 36, 37, in the form of circumferential surfaces 36, 37 of carrier wheels 42, 43 which are coupled via the clutch 16 with the folding rollers 1, 2, for circulation in a circulation sense which corresponds to the rotation sense of the folding rollers 1, 2, and which define a carrier area 44 situated between the circulating surfaces 36, 37 (see FIG. 5). The carrier pawl 35 is movable relative to the circulating surfaces 36, 37, between positions on opposite sides of the carrier area 44. To this end, the circulating surfaces 36, 37 in the carrier area 44 are arranged, upon reversal of the circulation sense of the circulating surfaces 36, 37, to engage between them the carrier pawl 35 from one of the opposite sides of the carrier area 44 (see FIGS. 1-3) to the other one of the opposite sides of the carrier area 44 (see FIG. 4). The folding blade 24 is suspended so as to be pivotable about an axis 45 with respect to a fixed frame part of the apparatus via arms 38, 39. Also, a spring 46 is provided which urges the arms 38, 39 to a position in which the carrier pawl 35 coupled thereto is situated in the carrier area 44. The spring 46 has an end which is attached to a fixed frame part of the apparatus and an end which is attached to the arms 38, 39.

Starting from the position represented in FIGS. 1-3, upon reversal of the rotation sense of the motor 13, whereby also the rotation sense of the carrier wheels 42, 43 is reversed, the carrier pawl 35 is carried along by the circumferential surfaces 36, 37 of the carrier wheels 42, 43 through the carrier area 44. The spring 46 then ensures that the carrier pawl 35 always rests against the circumferential surfaces 36, 37 with enough pressure to be carried along by these surfaces through the carrier area 44. Upon renewed reversal of the rotation sense of the motor 12 and the carrier wheels 42, 43, the reverse effect occurs and the carrier pawl 35 is carried along to the other side of the carrier area 44 again, whereby the folding blade 24 coupled to the carrier pawl 35 returns from the position for introducing a portion of a sheet between the folding rollers 1, 2 to a position remote from the folding rollers 1, 2.

It is noted that it is also possible to provide that the circulating surfaces that carry the carrier pawl along are part of the folding rollers. However, it is preferred that, as in the exemplary embodiment shown, the circulating surfaces 36, 37 each form part of an element 42, 43 separate from the folding rollers 1, 2 and are coupled with the folding rollers 1, 2, for starting at least rotation of the folding rollers 1, 2 in the output rotation sense 25 after circulation of the elements 36, 37 in the corresponding circulation sense has started and the carrier pawl 35 has thereby been carried along from one of the opposite sides of the carrier area 44 to the other one of the opposite sides of the carrier area 44. This provides the advantage that it is ensured that a portion of a sheet 4 in which a fold 28 is to be provided has been brought into a controlled position close to the folding nip 3, from where the sheet is reliably pulled into the folding nip 3 when rotation of the folding rollers 1, 2 is started. This in turn is advantageous for the accurate control of the position where the fold is provided.

The delayed start of rotation of the folding rollers 1, 2 upon reversal of rotation of the carrier wheels 42, 43 to the output rotation sense is obtained, according to this example, by the earlier-described lost motion clutch 16 which is included between the carrier wheel 43 and the folding roller 2. This lost motion clutch 16 allows a free angular displacement between the input shaft 33 and the output shaft 34, in the nature of play through a rotation angle.

According to the example represented, a portion of the second section 10, prior to the movement of the folding blade 24, is deflected, with respect to a transport plane extending through the folding nip 3 and at right angles to a plane determined by axes of the folding rollers 1, 2, in a first direction, and the first section 9 is deflected with respect to that transport plane in a second direction opposite to this first direction. As the two parts of the sheet 4 are thus deflected in opposite directions, forming the loop 6 and urging the second section 10 of the sheet 4 towards the folding nip 3 prior to the actual formation of the folds requires relatively small maximum bending of the sheet 4, which is advantageous for a reliable operation and limiting the risk of damage or curling of the sheet.

The apparatus according to the example shown is further equipped with guides 31, 32 which determine an input path and an output path for inputting a sheet 4 along an input path from a side of the folding nip 3 opposite to the side of the folding nip 3 where the first section 9 is buckled into a loop 6 and for outputting the sheet 4 along an output path other than the input path on a side of the folding nip 3 opposite to the side of the folding nip 3 where the first section 9 has been buckled into a loop 6.

This makes it possible to input the sheet 4 from a side of the folding nip 3 opposite to the side of the folding nip 3 where the first section 9 is buckled into a loop 6, and to output the folded sheet 4 on that side as well, while the sheet 4, after folding, leaves the folding nip 3 along an output path other than the input path. Input and output can therefore be done on the same side of the folding nip 3 and yet along different paths. As a consequence, the apparatus is simple in use and the output of a sheet does not hinder the input of a next sheet.

The invention claimed is:

1. A method for folding a sheet of paper, comprising:

supplying a sheet between a pair of folding rollers rotating in an input rotation sense, the sheet having a first section and a second section wherein the second section precedes the first section in the supplying of the sheet between the folding rollers;

causing the first section of the sheet to buckle into a loop by, during rotation of the folding rollers in the input rotation sense, stopping with respect to portions of the sheet transported between the folding rollers a portion of the sheet remotely downstream of the folding rollers;

bending the second section of the sheet situated between opposite ends of the sheet on a side of the loop remote from the folding rollers to a folding nip formed by and between the folding rollers, the bending producing a bent portion;

rotating the folding rollers in an output rotation sense opposite to the input rotation sense, whereby sections of the folding rollers in the area of the folding nip transport said bent second section of the sheet into the folding nip; and transporting the bent portion of the sheet through the folding nip, whereby a first fold is formed in said second section of the sheet and subsequently a trailing end of the loop is deformed into a second fold;

wherein said supplying of the sheet between the folding rollers is at a first side of the folding nip, and said bending of the sheet is towards a second side of the folding nip opposite said first side.

2. A method according to claim 1, wherein said bending of the sheet includes an urging of said bent portion of the sheet to the folding nip carried out by moving a folding blade, on a side of the sheet remote from the folding nip, to the folding nip.

3. A method according to claim 2, wherein a portion of the second section, prior to movement of the folding blade, is deflected, with respect to a transport plane extending through the folding nip and at right angles to a plane defined by axes of the folding rollers, to a first side of said transport plane and wherein the first section is deflected, with respect to the transport plane, to a second side of said transport plane, opposite said first side.

4. A method according to claim 1, further comprising inputting the sheet from the first side of the folding nip.

5. A method according to claim 1, further comprising outputting the folded sheet on the first side of the folding nip.

6. A method according to claim 1, wherein the sheet is passed along an input path to the folding nip and, after folding, leaves the folding nip along an output path other than the input path.

7. An apparatus for folding a sheet of paper, comprising:

a pair of folding rollers which define a folding nip situated therebetween;

a drive coupled with the folding rollers, with a control for rotating the folding rollers in an input rotation sense for supplying at least a portion of the sheet through the folding nip;

a stop downstream of the folding rollers, for, during rotation of the folding rollers in the input rotation sense for supplying the sheet, stopping a portion of the sheet with respect to portions of the sheet transported between the folding rollers, causing a first section of the sheet to buckle into a loop;

means for bending a second section of the sheet situated between opposite ends of the sheet on a side of the loop remote from the folding rollers to the folding nip; and the drive coupled with the folding rollers, with the control being arranged for subsequently rotating the folding rollers in an output rotation sense opposite to the input rotation sense, whereby the bent portion of the sheet is transported through the folding nip and a first fold is formed in said second section and subsequently a trailing end of the loop is deformed into a second fold.

8. An apparatus according to claim 7, further comprising guides which define an input path and an output path for inputting along an input path a sheet from a side of the folding nip opposite to the side of the folding nip where the first section is buckled into a loop and for outputting the sheet along an output path other than the input path on a side of the folding nip opposite to the side of the folding nip where the first section has been buckled into a loop.

9. An apparatus according to claims 7, further comprising a folding blade which is movable from a position remote from the folding nip to a position closer to the folding nip for bending said portion of the sheet to the folding nip.

10. An apparatus according to claim 9, whereto said drive comprises:

a motor which is coupled via a transmission with the folding blade for selectively driving displacements of the folding blade towards the folding nip and away from the folding nip and with the folding rollers for reversing the rotation sense in which the folding rollers are driven, each time at or after one of said displacements.

11. An apparatus according to claim 10, wherein the transmission comprises:

a carrier pawl which is coupled with the folding blade, and a pair of circulating surfaces which are coupled with or are part of the folding rollers for circulation in a circulation sense corresponding to the rotation sense of the folding rollers and which define a carrier area situated between said circulating surfaces, wherein the carrier pawl is movable along said circulating surfaces between positions situated on opposite sides of the carrier area, wherein said circulating surfaces in the carrier area are arranged for engaging the carrier pawl for, upon reversal of the circulation sense of the circulating surfaces, carrying along between them the carrier pawl from one of the opposite sides of the carrier area to the other one of said opposite sides of the carrier area.

12. An apparatus according to claim 11, wherein said circulating surfaces each form part of an element separate from the folding rollers, which is coupled with the folding rollers, for starting at least rotation of the folding rollers in the output rotation sense after circulation of the element in the corresponding circulation sense has started and the carrier pawl has thereby been carried along from one of the opposite sides of the carrier area to the other one of said opposite sides of the carrier area.

* * * * *